US007549241B2

(12) United States Patent
Ioku et al.

(10) Patent No.: US 7,549,241 B2
(45) Date of Patent: Jun. 23, 2009

(54) HYDRAULIC CONTROL DEVICE FOR LOADER

(75) Inventors: Kensuke Ioku, Kobe (JP); Jun Nakano, Kobe (JP); Yasunori Hatanaka, Kobe (JP)

(73) Assignee: Nabtesco Corporation, Tokyo (JP)

( * ) Notice: Subject to any disclaimer, the term of this patent is extended or adjusted under 35 U.S.C. 154(b) by 584 days.

(21) Appl. No.: 11/483,421

(22) Filed: Jul. 7, 2006

(65) Prior Publication Data

US 2007/0006491 A1 Jan. 11, 2007

(30) Foreign Application Priority Data

Jul. 7, 2005 (JP) ..... 2005-199131
Jul. 7, 2005 (JP) ..... 2005-199132
May 30, 2006 (JP) ..... 2006-150048

(51) Int. Cl.
*E02F 5/02* (2006.01)
*F15B 13/02* (2006.01)

(52) U.S. Cl. ..... 37/348; 60/421; 60/422

(58) Field of Classification Search ..... 37/348, 37/414, 466, 902; 60/421, 422, 430, 426, 60/446, 443–445; 91/392, 418, 419, 446; 701/50

See application file for complete search history.

(56) References Cited

U.S. PATENT DOCUMENTS 5,673,558 A * 10/1997 Sugiyama et al. ..... 60/426
6,050,090 A * 4/2000 Tohji ..... 60/421
6,820,355 B2 * 11/2004 Yoshino et al. ..... 37/348
7,275,369 B2 * 10/2007 Kim ..... 60/422

FOREIGN PATENT DOCUMENTS

JP 07-252857 10/1995
JP 2001-124011 5/2001

OTHER PUBLICATIONS

Patent Abstracts of Japan; Publication No. 07-252857; Date of publication: Oct. 3, 1995 (2 pages).
Patent Abstracts of Japan; Date of publication: May 8, 2001; Publication No. 2001-124011 (2 pages).

* cited by examiner

*Primary Examiner*—Robert E Pezzuto
(74) *Attorney, Agent, or Firm*—Osha • Liang LLP

(57) ABSTRACT

An arm direction changeover valve (11) is provided in an arm block (20). A first pilot check valve (18) is provided in a first block (21). A second pilot check valve (19) is provided in a second block (22). The three blocks, i.e., the arm block (20), the first block (21), and the second block (22) are arranged side by side. The first block (21) and the second block (22) are arranged to be contiguous to each other. Accordingly, an increase in size can be prevented even if a float mechanism and a multi-direction changeover valve are formed integrally with each other.

12 Claims, 11 Drawing Sheets

2

HYDRAULIC CONTROL DEVICE FOR LOADER

TECHNICAL FIELD

This invention relates to a hydraulic control device for a loader that is capable of, in a front loader of a construction machine or a material handling machine having an arm and a bucket, operating a float mechanism by which the arm is brought into a floating state, that is capable of performing a function to move the bucket in a state of being parallel to the ground surface when the arm is manipulated, and that is capable of performing a function to move the bucket in a state of being kept at a constant angle with the ground surface.

BACKGROUND ART

Conventionally, a hydraulic control device for a loader is known in which a lift arm having a working implement, such as a bucket, at its end is brought into a floating state in a front loader, i.e., in which a lift arm is brought into a state of being freely moved up and down while keeping the working implement provided at the end of the arm in contact with the ground by simultaneously draining oil from an expansion oil chamber and from a contraction oil chamber of a lift cylinder by which the lift arm is moved up and down (see Japanese Published Unexamined Patent Application No. 2001-124011, which is hereinafter referred to as "patent document 1").

However, in the hydraulic control device for a loader disclosed by patent document 1, a first valve mechanism that is a multi-direction changeover valve including direction changeover valves that control a pressure-oil supply to each actuator is disposed on the side of a driver's seat in a tractor, whereas a second valve mechanism that is a float mechanism used to create a floating state is disposed on the side of the front loader. Since the float mechanism and the multi-direction changeover valve are provided separately from each other in this way, pipes through which these valve mechanisms are connected together are needed. Additionally, since the device size is increased even if the float mechanism and the multi-direction changeover valve described in patent document 1 are formed integrally with each other, there is a risk that a great increase in cost may be caused.

Additionally, conventionally, a hydraulic control device for a loader is known in which, in a front loader including an arm and a bucket provided as an attachment to the end of the arm, the bucket is moved in a state of being parallel to the ground surface (i.e., horizontal to the ground surface) while a constant angle with the ground surface is maintained when the arm is manipulated (see Japanese Published Unexamined Patent Application No. H7-252857, which is hereinafter referred to as "patent document 2"). The hydraulic control device for a loader disclosed by patent document 2 includes an arm direction changeover valve that controls a supply of pressure oil to an arm cylinder, a bucket direction changeover valve that controls a supply of pressure oil to a bucket cylinder, and a flow dividing mechanism through which, when the arm is manipulated, the bucket is moved in a parallel state by dividing the flow of the pressure oil returned from the arm cylinder and then supplying a part of the pressure oil to the bucket cylinder when the arm direction changeover valve is operated. In the hydraulic control device for a loader disclosed by document 2, the arm direction changeover valve, the bucket direction changeover valve, and the flow dividing mechanism are united together.

However, in the hydraulic control device for a loader of patent document 2 (Japanese Published Unexamined Patent Application No. H7-252857), the flow dividing mechanism is disposed between the arm direction changeover valve and the bucket direction change over valve. The flow dividing mechanism includes a flow dividing valve (i.e., a flow dividing valve 20*a*) and a return oil passage open-close valve (i.e., a brake valve 19). The flow dividing valve divides the flow of the pressure oil returned from the arm cylinder and then supplies part of the pressure oil to the bucket cylinder when the arm direction changeover valve is operated. The return oil passage open-close valve opens or closes a return oil passage through which pressure oil returned from the bucket cylinder flows when the bucket is moved in a parallel state. The flow dividing valve and the return oil passage open-close valve are disposed side by side in this order between the arm direction changeover valve and the bucket direction changeover valve. Therefore, even if the arm direction changeover valve, the bucket direction changeover valve, and the flow dividing mechanism are formed to be united together, the hydraulic control device for a loader is elongated in one direction, and is increased in size. As a result, disadvantageously, in a material handling machine, it becomes difficult to secure a space for disposing the hydraulic control device for a loader. Additionally, in the hydraulic control device for a loader of patent document 2, relief valves (i.e., a relief valve 16 and a relief valve 18) are disposed along a direction in which the arm direction changeover valve, the flow dividing mechanism, and the bucket direction changeover valve are disposed side by side. Therefore, the hydraulic control device for a loader is further elongated in one direction, and is increased in size, thus it becomes difficult to secure a space for disposing the device. Additionally, when a variable throttle that adjusts the amount of oil, which is part of the pressure oil returned from the arm cylinder and which is selectively flowed to the bucket cylinder, is attached to the flow dividing valve, the hydraulic control device for a loader will be increased in size and will have difficulty in obtaining a space to be disposed if the variable throttle is united with the arm direction changeover valve and the bucket direction changeover valve without changing the form of the variable throttle.

DISCLOSURE OF THE INVENTION

The present invention has been made in consideration of these circumstances, and it is a first object of the present invention to provide a hydraulic control device for a loader capable of preventing an increase in the size of the device even if a float mechanism and a multi-direction changeover valve are formed integrally with each other.

In consideration of the circumstances, it is a second object of the present invention to provide a hydraulic control device for a loader capable of preventing an increase in the size of the device even if an arm direction changeover valve, a bucket direction changeover valve, and a flow dividing mechanism are formed integrally with each other.

In consideration of the circumstances, it is a third object of the present invention to provide a hydraulic control device for a loader capable of preventing an increase in the size of the device even if an arm direction changeover valve, a bucket direction changeover valve, a flow dividing mechanism, and a relief valve are formed integrally with each other.

To achieve the first object, according to a first aspect of the present invention, the hydraulic control device for a loader includes an arm direction changeover valve that controls a supply of pressure oil to an arm cylinder; a bucket direction changeover valve that controls a supply of pressure oil to a bucket cylinder; a first pilot check valve provided between a first chamber of the arm cylinder and a tank; and a second pilot check valve provided between a second chamber of the arm cylinder and the tank, and the hydraulic control device for a loader brings an arm into a floating state by opening the first pilot check valve and the second pilot check valve.

The hydraulic control device for a loader according to the first aspect of the present invention to achieve the first object is characterized by further including an arm block in which the arm direction changeover valve is provided; a first block in which one of the first pilot check valve and the second pilot check valve is provided; and a second block in which the other one of the first pilot check valve and the second pilot check valve is provided, wherein the three blocks, namely, the arm block, the first block, and the second block are arranged side by side, and wherein the first block and the second block are arranged to be contiguous to each other.

According to this structure, the first and second pilot check valves that are constituents of the float mechanism by which a floating state is achieved and the arm direction changeover valve of the multi-direction changeover valve can be formed integrally with each other, and pipes through which these valves are connected together can be made unnecessary. Additionally, the blocks in which the first and second pilot check valves are provided and the block in which the arm direction changeover valve is provided are formed as mutually different blocks, and these blocks are arranged side by side. Therefore, these blocks can be disposed in an area to which the reflection of the arm direction changeover valve is cast (i.e., these blocks can be arranged so as to lie on each other when viewed planarly), and the hydraulic control device for a loader can be prevented from increasing in size. Therefore, even if the float mechanism and the multi-direction changeover valve are formed integrally with each other, it is possible to provide a hydraulic control device for a loader capable of preventing an increase in the size of the device.

The hydraulic control device for a loader according to the first aspect of the present invention may further include a flow dividing valve that, when the arm is operated, moves the bucket in a parallel state by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows; wherein the flow dividing valve is provided in the first block.

According to this structure, either the first pilot check valve or the second pilot check valve and the flow dividing valve are both provided in the first block. Therefore, a space in which the first block is provided can be efficiently used, and the hydraulic control device for a loader can be prevented from increasing in size even if the first or second pilot check valve and the flow dividing valve are formed integrally with the arm direction changeover valve.

The hydraulic control device for a loader according to the first aspect of the present invention may further include a flow dividing valve that, when the arm is operated, moves the bucket in a parallel state by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows; wherein the return oil passage open-close valve is provided in the first block.

According to this structure, either the first pilot check valve or the second pilot check valve and the return oil passage open-close valve are both provided in the first block. Therefore, a space in which the first block is provided can be efficiently used, and the hydraulic control device for a loader can be prevented from increasing in size even if the first or second pilot check valve and the return oil passage open-close valve are formed integrally with the arm direction changeover valve.

The hydraulic control device for a loader according to the first aspect of the present invention may further include a flow dividing valve that, when the arm is operated, moves the bucket in a parallel state by dividing a flow of pressure oil returned from the arm cylinder and then supplying part of the pressure oil to the bucket cylinder when the arm direction changeover valve is operated; a return oil passage open-close valve that, when the bucket is moved in parallel, opens or closes a return oil passage through which pressure oil returned from the bucket cylinder flows; and a variable throttle that adjusts an amount of oil, which is part of the pressure oil returned from the arm cylinder and which is selectively flowed to the bucket cylinder; wherein the variable throttle is provided in the second block.

According to this structure, either the first pilot check valve or the second pilot check valve and the variable throttle are both provided in the second block. Therefore, a space in which the second block is provided can be efficiently used, and the hydraulic control device for a loader can be prevented from increasing in size even if the first or second pilot check valve and the variable throttle are formed integrally with the arm direction changeover valve.

A hydraulic control device for a loader according to a second aspect of the present invention includes an arm direction changeover valve that controls a supply of pressure oil to an arm cylinder; a bucket direction changeover valve that controls a supply of pressure oil to a bucket cylinder; a flow dividing valve that, when an arm is operated, moves a bucket in a parallel state by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows; wherein the flow dividing valve and the return oil passage open-close valve are disposed between the arm direction changeover valve and the bucket direction changeover valve.

The hydraulic control device for a loader according to the second aspect of the present invention to achieve the second object is characterized by further including an arm block in which the arm direction changeover valve is provided; a bucket block in which the bucket direction change over valve is provided; and a first block disposed between the arm block and the bucket block; wherein the flow dividing valve and the return oil passage open-close valve are provided in the first block, and lie in a plane perpendicular to a plane in which the arm direction changeover valve and the bucket direction changeover valve lie.

According to this structure, the first block is disposed between the arm block in which the arm direction changeover valve is disposed and the bucket block in which the bucket direction changeover valve is disposed. The flow dividing valve and the return oil passage open-close valve both of which are disposed in the first block lie in a plane perpendicular to a plane in which the arm direction changeover valve and the bucket direction changeover valve lie. Therefore, the hydraulic control device for a loader can be prevented from being elongated in one direction even if the flow dividing mechanism including the flow dividing valve and the return oil passage open-close valve is disposed between the arm direction changeover valve and the bucket direction changeover valve, and is formed integrally with these valves. This makes it easy to secure the space to install the hydraulic control device for a loader in a material handling machine. Therefore, according to the present invention, it is possible to provide a hydraulic control device for a loader capable of preventing an increase in the size of the device even if the arm direction changeover valve, the bucket direction changeover valve, and the flow dividing mechanism are formed integrally with each other.

The hydraulic control device for a loader according to the second aspect of the present invention may further include a variable throttle that adjusts an amount of oil which is part of the pressure oil returned from the arm cylinder and which is selectively flowed to the bucket cylinder, and the variable throttle may be provided in a second block contiguous to the first block, in which the flow dividing valve and the return oil passage open-close valve are provided, on an opposite side of the arm block.

According to this structure, the variable throttle that adjusts the amount of oil to be selectively flowed is disposed in the second block contiguous to the first block, in which the flow dividing valve and the return oil passage open-close valve are disposed, on the opposite side with respect to the arm block. Therefore, the variable throttle is disposed in the second block near the flow dividing valve, and hence the length of an oil passage through which the flow dividing valve and the variable throttle are connected together can be shortened, and the space in which the second block is provided can be efficiently used. Therefore, the hydraulic control device for a loader can be prevented from increasing in size even if the flow dividing mechanism including the variable throttle is formed integrally with the arm direction changeover valve and the bucket direction changeover valve.

A hydraulic control device for a loader according to a third aspect of the present invention includes an arm direction changeover valve that controls a supply of pressure oil to an arm cylinder; a bucket direction changeover valve that controls a supply of pressure oil to a bucket cylinder; a flow dividing valve that, when an arm is operated, moves a bucket in a parallel state by dividing a flow of pressure oil returned from the arm cylinder and then supplying part of the pressure oil to the bucket cylinder when the arm direction changeover valve is operated; a return oil passage open-close valve that, when the bucket is moved in parallel, opens or closes a return oil passage through which pressure oil returned from the bucket cylinder flows; and a variable throttle that adjusts an amount of oil which is part of the pressure oil returned from the arm cylinder and which is selectively flowed to the bucket cylinder; wherein the flow dividing valve and the return oil passage open-close valve are disposed between the arm direction changeover valve and the bucket direction changeover valve.

The hydraulic control device for a loader according to the third aspect of the present invention to achieve the second object is characterized by further including an arm first port connected to a first chamber of the arm cylinder; an arm second port connected to a second chamber of the arm cylinder; and a second block disposed between the arm direction changeover valve and the bucket direction changeover valve; wherein the arm second port and the variable throttle are provided in the second block.

According to this structure, the flow dividing valve and the return oil passage open-close valve are disposed between the arm direction changeover valve and the bucket direction change over valve. The arm second port and the variable throttle are provided in the second block disposed between the arm direction changeover valve and the bucket direction changeover valve. Therefore, when an oil passage leading to the variable throttle from the arm second port is formed, the length of this oil passage can be minimized by providing the arm second port and the variable throttle in the second block, and the space in which the second block is provided can be efficiently used. Therefore, the hydraulic control device for a loader can be prevented from increasing in size even if the flow dividing mechanism including the variable throttle is formed integrally with the arm direction changeover valve and the bucket direction changeover valve.

The hydraulic control device for a loader according to the third aspect of the present invention may further include a first block disposed between the arm direction changeover valve and the second block, wherein the flow dividing valve and the return oil passage open-close valve are provided in the first block.

According to this structure, the first block in which the flow dividing valve and the return oil passage open-close valve are provided is disposed between the arm direction changeover valve and the second block. As a result, the flow dividing valve and the return oil passage open-close valve are disposed between the arm second port and the arm direction changeover valve. Therefore, when an oil passage leading to the flow dividing valve from the arm second port and the variable throttle is formed, the length of this oil passage can be minimized, and the space in which the first block is provided can be efficiently used.

The hydraulic control device for a loader according to the third aspect of the present invention may have a structure in which an overload relief valve communicating with the first chamber of the arm cylinder is provided in the second block in which the variable throttle is provided.

According to this structure, the overload relief valve, the arm second port, and the variable throttle are all provided in the second block. Therefore, the space in which the second block is provided can be efficiently used, and the hydraulic control device for a loader can be prevented from increasing in size.

The hydraulic control device for a loader according to the third aspect of the present invention may further include a first pilot check valve provided between the first chamber of the arm cylinder and a tank; and a second pilot check valve provided between the second chamber of the arm cylinder and the tank; wherein either the first pilot check valve or the second pilot check valve is provided in the second block.

According to this structure, the first or second pilot check valve, the arm second port, and the variable throttle are all provided in the second block. Therefore, the space in which the second block is provided can be efficiently used, and the hydraulic control device for a loader can be prevented from increasing in size.

A hydraulic control device for a loader according to a fourth aspect of the present invention includes a center bypass passage connected to an oil pressure source; an arm direction changeover valve that controls a supply of pressure oil from the center bypass passage to an arm cylinder; a bucket direction changeover valve that controls a supply of pressure oil from the center bypass passage to a bucket cylinder; a flow dividing valve that, when an arm is operated, moves a bucket in a parallel state by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows; wherein the flow dividing valve and the return oil passage open-close valve are disposed between the arm direction changeover valve and the bucket direction changeover valve.

The hydraulic control device for a loader according to the fourth aspect of the present invention to achieve the third object is characterized by further including an arm block in which the arm direction changeover valve is provided; a bucket block in which the bucket direction changeover valve is provided; and a first block disposed between the arm block and the bucket block; wherein the flow dividing valve and the return oil passage open-close valve are provided in the first block, and lie in an orthogonal plane perpendicular to a block crossing plane in which the arm direction changeover valve and the bucket direction changeover valve lie; and wherein the arm direction changeover valve, a first-chamber-side overload relief valve that leads to a first chamber of the arm cylinder, and a main relief valve connected to the center bypass passage are arranged in a three-stacked manner in a first plane of the arm block that is parallel to the orthogonal plane.

According to this structure, the first block is disposed between the arm block including the arm direction changeover valve and the bucket block including the bucket direction changeover valve. The flow dividing valve and the return oil passage open-close valve provided in the first block lie in the orthogonal plane perpendicular to the block crossing plane in which the arm direction changeover valve and the bucket direction changeover valve lie. Further, in the first plane of the arm block parallel to the orthogonal plane, the arm direction changeover valve, the first-chamber-side overload relief valve, and the main relief valve are arranged in a three-stacked manner. Therefore, the hydraulic control device for a loader can be prevented from being elongated in one direction even if the flow dividing mechanism including the flow dividing valve and the return oil passage open-close valve is disposed between the arm direction changeover valve and the bucket direction changeover valve, and is formed integrally therewith. Additionally, since the arm direction changeover valve, the first-chamber-side overload relief valve, and the main relief valve are arranged in a three-stacked manner in the first plane parallel to the orthogonal plane, the relief valves can also be densely arranged in a narrow space in a compact manner, and the hydraulic control device for a loader can be prevented from being elongated in one direction. This makes it easy to secure the installation space for the hydraulic control device for a loader in the material handling machine. Therefore, according to the present invention, the hydraulic control device for a loader capable of preventing an increase in size can be provided even if the arm direction changeover valve, the bucket direction changeover valve, the flow dividing mechanism, and the relief valve are formed integrally with each other.

The hydraulic control device for a loader according to the fourth aspect of the present invention may further include a second block, which is disposed between the first block and the bucket block and which includes a variable throttle that adjusts an amount of oil that is part of the pressure oil returned from the arm cylinder and that is selectively flowed to the bucket cylinder; and a second-chamber-side overload relief valve leading to a second chamber of the arm cylinder; wherein the variable throttle is disposed to be overlapped with the second-chamber-side overload relief valve in parallel with the second-chamber-side overload relief valve and in a direction perpendicular to the block crossing plane between the orthogonal plane and a second plane of the second block in which the second-chamber-side overload relief valve lies and which is parallel to the orthogonal plane.

According to this structure, the variable throttle and the second-chamber-side overload relief valve are provided in the second block located between the first block and the bucket block. The variable throttle is disposed to be overlapped with the second-chamber-side overload relief valve in parallel with this overload relief valve and in the direction perpendicular to the block crossing plane between the orthogonal plane and the second plane in which the second-chamber-side overload relief valve lies and that is parallel to the orthogonal plane. Therefore, even if the variable throttle that adjusts the amount of oil to be selectively flowed is attached to the flow dividing valve, the flow dividing valve and the second-chamber-side overload relief valve can be arranged close to the position where no interference occurs therebetween, and can be densely arranged in the narrow space in a compact manner. Therefore, even if the variable throttle is attached to the flow dividing valve, the hydraulic control device for a loader can be prevented from increasing in size.

The above-described object and other objects, features, and advantages of the present invention will become apparent from a reading of the following description with reference to the accompanying drawings.

BEST MODE FOR CARRYING OUT THE INVENTION

Preferred embodiments of the present invention will be hereinafter described with reference to the accompanying drawings. A hydraulic control device for a loader according to the embodiment of the present invention can be widely used as a hydraulic control device for a loader that includes a float mechanism, by which an arm is brought into a floating state, in a front loader of a construction machine or a material handling machine provided with such an arm and a bucket.

First Embodiment

Figure 1:
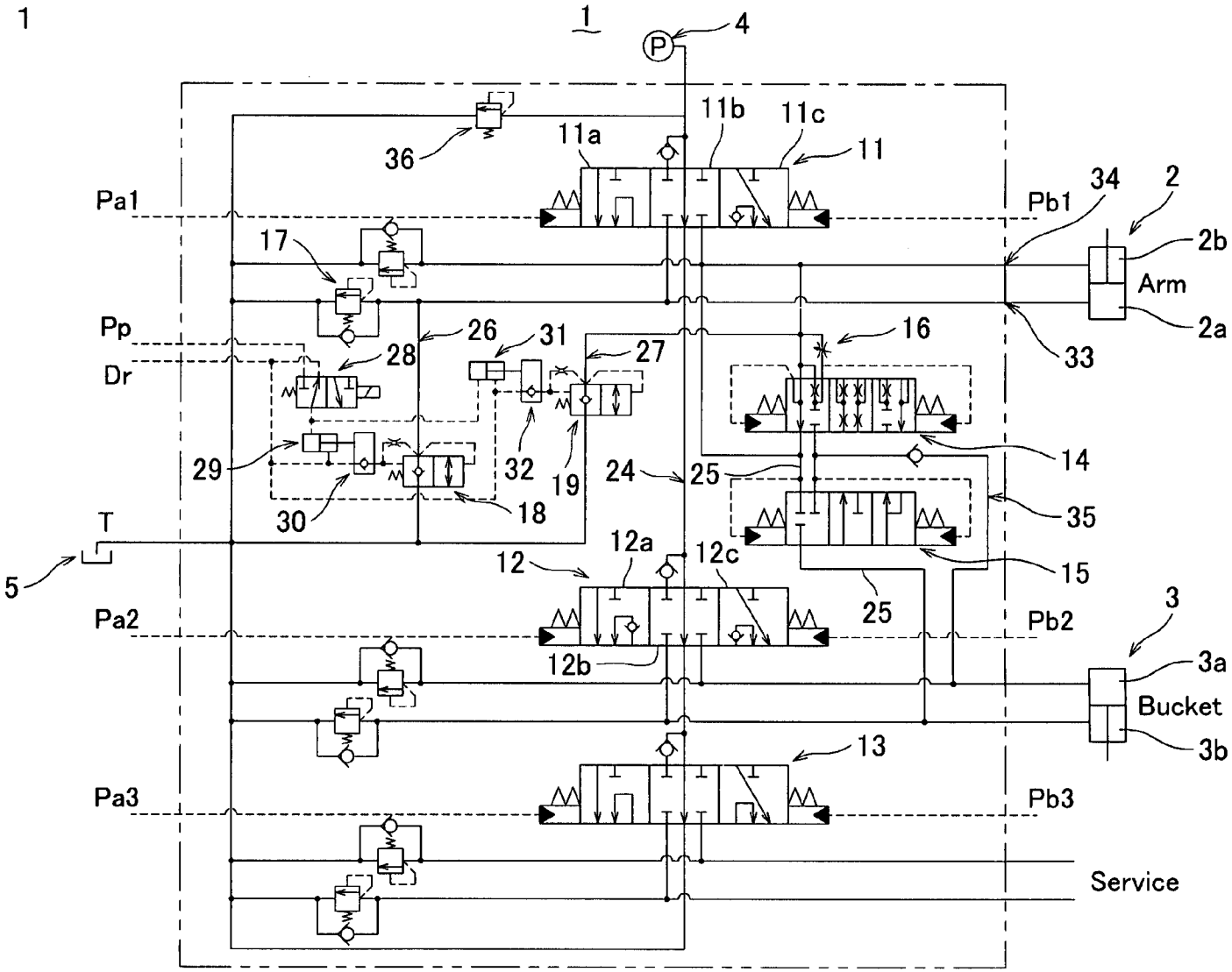
FIG. 1 is a hydraulic circuit diagram of a hydraulic control device for a loader according to a first embodiment of the present invention.

FIG. 1 is a hydraulic circuit diagram showing a hydraulic control device 1 for a loader according to a first embodiment of the present invention. The hydraulic control device 1 for a loader shown in FIG. 1 is included in a construction machine (not shown) or a material handling machine (not shown), and is used as a hydraulic control device for controlling the operation of a front loader of the construction machine provided with an arm and a bucket. The hydraulic control device for a loader 1 is made up of an arm direction changeover valve 11, a bucket direction changeover valve 12, a service direction changeover valve 13, a flow dividing valve 14, a return oil passage open-close valve 15, a variable throttle 16, an overload relief valve 17, a first pilot check valve 18, a second pilot check valve 19, etc.

As shown in FIG. 1, the hydraulic control device for a loader 1 has a center bypass passage 24 through which pressure oil supplied from an oil pressure pump 4 flows to a tank 5. The arm direction changeover valve 11, the bucket direction changeover valve 12, and the service direction changeover valve 13 are disposed along the center bypass passage 24. Pressure oil is supplied to each of the direction changeover valves 11, 12, and 13 through a parallel passage. Thus, the hydraulic control device for a loader 1 is also formed as a multi-direction changeover valve.

The arm direction changeover valve 11 is formed as a direction changeover valve that controls a pressure-oil supply to an arm cylinder 2 used to drive an arm (not shown). In more detail, pressure oil is supplied to a first chamber 2*a* of the arm cylinder 2 by switching the arm direction changeover valve 11 from a neutral position 11*b* to a changeover position 11*a*, thus the arm is raised, whereas pressure oil is supplied to a second chamber 2*b* of the arm cylinder 2 by switching the arm direction changeover valve 11 from the neutral position 11*b* to a changeover position 11*c*, thus the arm is lowered.

The bucket direction changeover valve 12 is formed as a direction changeover valve that controls a pressure-oil supply to a bucket cylinder 3 used to drive a bucket (not shown). In more detail, pressure oil is supplied to a second chamber 3*b* of the bucket cylinder 3 by switching the bucket direction changeover valve 12 from a neutral position 12*b* to a changeover position 12*a*, thus the bucket is allowed to move in a scooping direction (i.e., backward tilting direction), whereas pressure oil is supplied to a first chamber 3*a* of the bucket cylinder 3 by switching the bucket direction changeover valve 12 from the neutral position 12*b* to a changeover position 12*c*, thus the bucket is allowed to move in a dumping direction (i.e., forward tilting direction).

When the arm direction changeover valve 11 is operated to perform switching to the changeover position 11*a*, the flow dividing valve 14 divides the flow of pressure oil returned from the second chamber 2*b* of the arm cylinder 2 and then supplies part of the pressure oil to the first chamber 3*a* of the bucket cylinder 3 as described later, and, as a result, the bucket is moved in a parallel state (i.e., in a horizontal state with respect to the ground surface) while the arm is being raised. When the bucket is moved in a parallel state, the return oil passage open-close valve 15 opens or closes a return oil passage 25 through which pressure oil returned from the second chamber 3*b* of the bucket cylinder 3 flows. The flow dividing valve 14 and the return oil passage open-close valve 15 are disposed between the arm direction changeover valve 11 and the bucket direction changeover valve 12.

The variable throttle 16 adjusts the amount of oil which is pressure oil returned from the second chamber 2*b* of the arm cylinder 2 and which is part of the pressure oil to be flowed to the bucket cylinder 3 when the arm is raised. The overload relief valve 17 communicates with the first chamber 2*a* of the arm cylinder 2, and can allow the first chamber 2*a* of the arm cylinder 2 to communicate with the tank 5 in accordance with the pressure of pressure oil.

The first pilot check valve 18 is disposed in an oil passage 26 through which the first chamber 2*a* of the arm cylinder 2 is connected to the tank 5. The first pilot check valve 18 serves as a check valve that blocks the flow of pressure oil from the first chamber 2*a* of the arm cylinder 2 to the tank 5, and is opened by the operation of an electromagnetic valve 28. In more detail, when the electromagnetic valve 28 is excited and opened, a check valve 30 is opened by the operation of a piston 29 into which pilot pressure oil has been introduced. Accordingly, pilot pressure oil on the side of one spring chamber of the first pilot check valve 18 is drained, so that a valve opening state is reached by pilot pressure oil that acts on the side of the other oil pressure chamber.

The second pilot check valve 19 is disposed in an oil passage 27 through which the second chamber 2*b* of the arm cylinder 2 is connected to the tank 5. The second pilot check valve 19 serves as a check valve that blocks the flow of pressure oil from the second chamber 2*b* of the arm cylinder 2 to the tank 5, and is opened by the operation of the electromagnetic valve 28. In more detail, when the electromagnetic valve 28 is excited and opened, a check valve 32 is opened by the operation of a piston 31 into which pilot pressure oil has been introduced. Accordingly, pilot pressure oil on the side of one spring chamber of the second pilot check valve 19 is drained, so that a valve opening state is reached by pilot pressure oil that acts on the side of the other oil pressure chamber.

Figure 2:
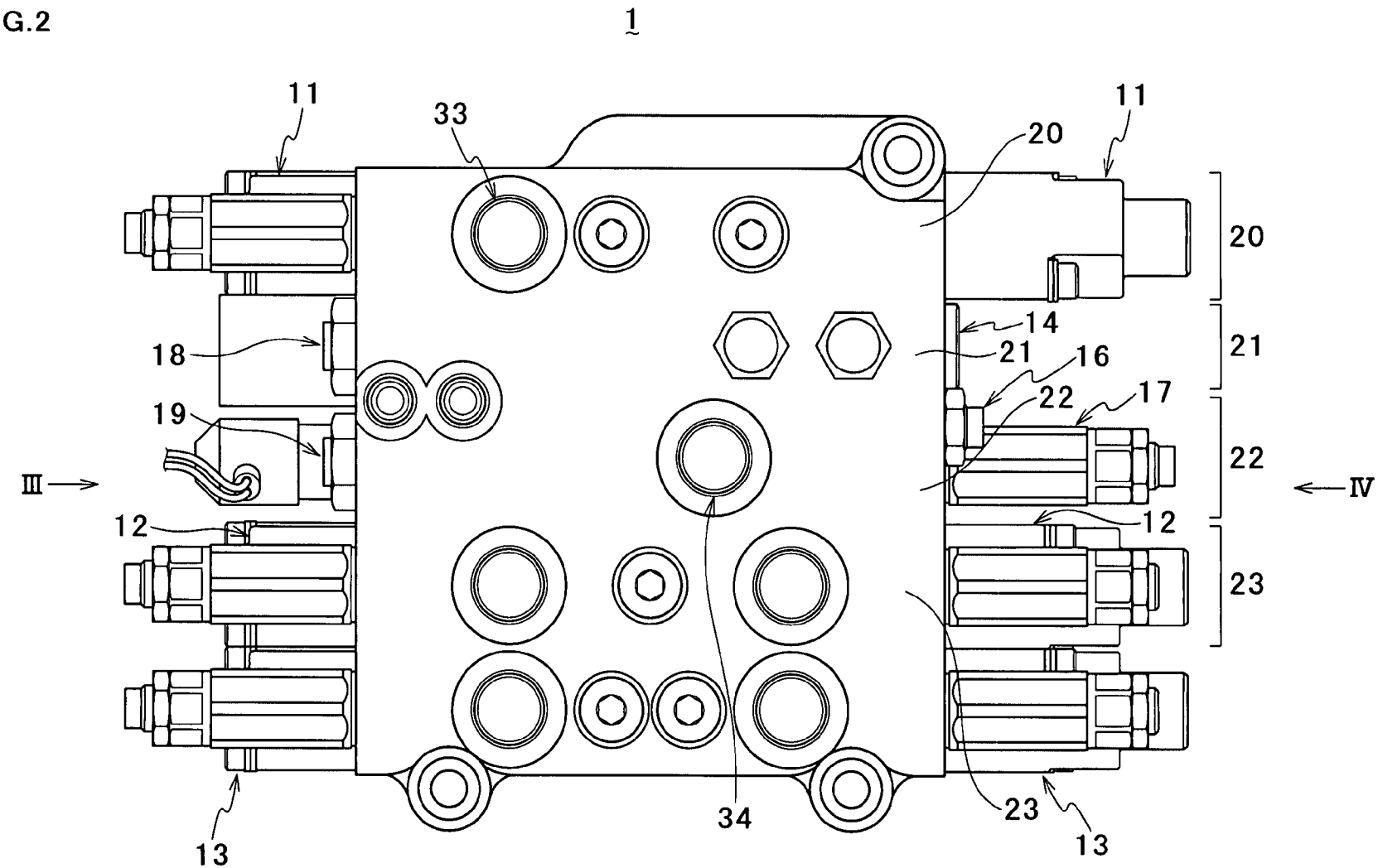
FIG. 2 is a plan view showing the externals of the hydraulic control device for a loader of FIG. 1.
Figure 3:
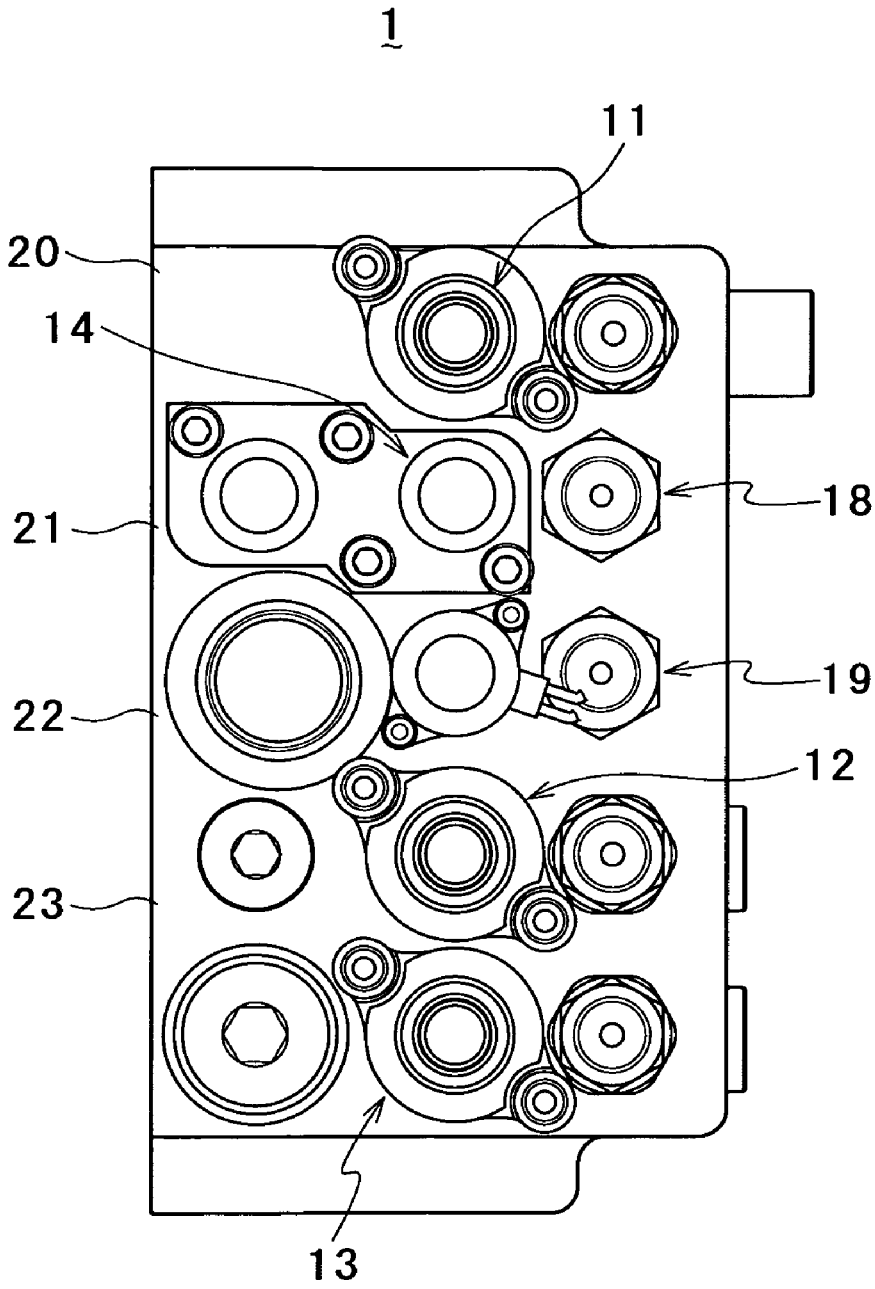
FIG. 3 is a side view from arrow III of FIG. 2.
Figure 4:
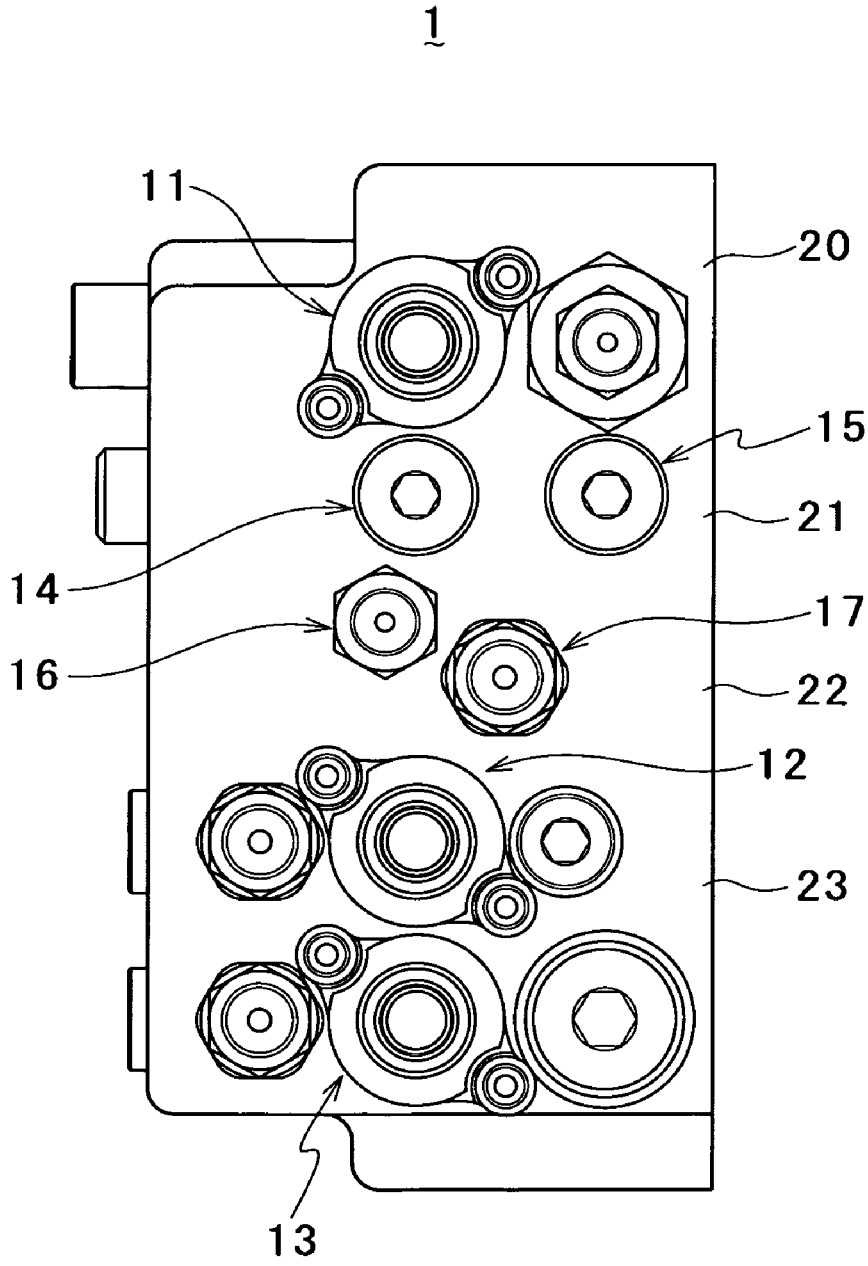
FIG. 4 is a side view from arrow IV of FIG. 2.

Next, a description will be given of an arrangement of the constituents of the hydraulic control device for a loader 1 with reference to FIG. 2 to FIG. 4. FIG. 2 is a plan view showing the externals of the hydraulic control device for a loader 1, FIG. 3 is a side view from arrow III of FIG. 2, and FIG. 4 is a side view from arrow IV of FIG. 2. As shown in FIG. 2 to FIG. 4, the hydraulic control device for a loader 1 is made up of an arm block 20, a first block 21, a second block 22, a bucket block 23, etc. These blocks 20, 21, 22, and 23 are formed integrally with each other.

The arm block 20 is a block in which the arm direction changeover valve 11 is disposed. The arm block 20 has an arm first port 33, which is one port that leads to the arm direction changeover valve 11 (see FIG. 2). The arm first port 33 is connected to the first chamber 2*a* of the arm cylinder 2 (see FIG. 1). The arm block 20 additionally has a main relief valve 36 shown in FIG. 1. The bucket block 23 is a block in which the bucket direction changeover valve 12 is disposed.

The first block 21 is disposed between the arm block 20 and the bucket block 23. The first block 21 includes the first pilot check valve 18, the flow dividing valve 14, and the return oil passage open-close valve 15. In the first block 21, the flow dividing valve 14 and the return oil passage open-close valve 15 lie in a plane perpendicular to a plane in which the arm direction changeover valve 11 and the bucket direction changeover valve 12 lie, as clearly shown in FIG. 4.

The second block 22 is disposed between the arm block 20 and the bucket block 23 (i.e., between the arm direction changeover valve 11 and the bucket direction changeover valve 12). The first block 21 is disposed between the second block 22 and the arm direction changeover valve 11 (i.e., between the second block 22 and the arm block 20). In other words, the second block 22 is contiguous to the first block 21 on the opposite side with respect to the arm block 20. The second block 22 includes the second pilot check valve 19, the variable throttle 16, and the overload relief valve 17. The second block 22 has an arm second port 34, which is the other port that leads to the arm direction changeover valve 11 (see FIG. 2). The arm second port 34 is connected to the second chamber 2*b* of the arm cylinder 2 (see FIG. 1).

As described above, in the hydraulic control device for a loader 1, the three blocks, i.e., the arm block 20, the first block 21, and the second block 22 are arranged side by side, and the first block 21 and the second block 22 are contiguous to each other.

Next, a description will be given of the operation of the thus structured hydraulic control device for a loader 1 with reference to FIG. 1. As described above, the arm is raised by switching the arm direction changeover valve 11 to the changeover position 11*a*, and is lowered by switching the arm direction changeover valve 11 to the changeover position 11*c*. The bucket is moved in the scooping direction by switching the bucket direction changeover valve 12 to the changeover position 12*a*, and is moved in the dumping direction by switching the bucket direction changeover valve 12 to the changeover position 12*c*.

The hydraulic control device 1 has a parallel movement function to move the bucket in a parallel state when the arm is raised. When the arm direction changeover valve 11 is switched to the changeover position 11*a*, pressure oil flowed from the oil pressure pump 4 is supplied to the first chamber 2*a* of the arm cylinder 2, and the arm begins rising. At this time, pressure oil returned from the second chamber 2*b* of the arm cylinder 2 flows to the flow dividing valve 14. The pressure oil that has flowed to the flow dividing valve 14 acts on two oil pressure chambers provided on both sides of the flow dividing valve 14, thereby the position of the flow dividing valve 14 is changed. As a result, the flow of the pressure oil returned from the second chamber 2*b* of the arm cylinder 2 is divided, and part of the pressure oil returned therefrom is supplied to the first chamber 3*a* of the bucket cylinder 3 through an oil passage 35. The remaining pressure oil is flowed from the center bypass passage 24 to the tank 5 through the arm direction changeover valve 11. The amount of oil that is pressure oil returned from the arm cylinder 2 and that is part of the pressure oil to be supplied to the bucket cylinder 3 is appropriately adjusted by the variable throttle 16.

The pressure oil the flow of which is divided by the flow dividing valve 14 and then supplied to the bucket cylinder 3 and the pressure oil that is flowed to the arm direction changeover valve 11 act on the oil pressure chambers provided on both sides of the return oil passage open-close valve 15, respectively as pilot pressure oil. Accordingly, the return oil passage open-close valve 15 is changed from a state of closing the return oil passage 25 to a state of opening the return oil passage 25, so that the pressure oil returned from the second chamber 3*b* of the bucket cylinder 3 is flowed through the return oil passage 25, is then passed through the arm direction changeover valve 11, and is flowed into the tank 5. Therefore, the bucket parallel movement function can be fulfilled by allowing the bucket to move in the dumping direction when the arm is raised.

The hydraulic control device for a loader 1 further fulfills a floating function to bring the arm into a floating state. To bring the arm into a floating state, the electromagnetic valve 28 is first excited and switched, for example, when the bucket is in contact with the ground. Thereafter, the piston 29 and the piston 31 are moved by pressure oil supplied from the pilot pump, so that the check valve 30 and the check valve 32 are opened. As a result, pilot pressure oil on the side of one spring chamber of the first and second pilot check valves 18 and 19 is drained, and switching is performed to open the valve by pilot pressure oil that acts on the side of the other oil pressure chamber thereof. A floating state in which the arm can be freely moved up and down in a state in which the bucket is in contact with the ground can be achieved by opening the first and second pilot check valves 18 and 19 in this way.

As described above, according to the hydraulic control device for a loader 1 used for a loader in this embodiment, the first and second pilot check valves 18 and 19 that are constituents of the float mechanism by which a floating state is achieved and the arm direction changeover valve 11 of the multi-direction changeover valve are formed integrally with each other, and hence pipes through which these constituents are connected together can be made unnecessary. Additionally, the blocks 21 and 22 in which the first and second pilot check valves 18 and 19 are provided and the block 20 in which the arm direction changeover valve 11 is provided are formed as mutually different blocks, and these blocks 20, 21, and 22 are arranged side by side. Therefore, these blocks 20, 21, and 22 can be disposed in an area to which the reflection of the arm direction changeover valve 11 is cast (i.e., these blocks can be arranged so as to lie on each other when viewed planarly), and the hydraulic control device for a loader can be prevented from increasing in size. Therefore, even if the float mechanism and the multi-direction changeover valve are formed integrally with each other, it is possible to provide a hydraulic control device for a loader capable of preventing an increase in size of the device.

Additionally, according to the hydraulic control device for a loader 1, both the first pilot check valve 18 and the flow dividing valve 14 are disposed in the first block 21. Therefore, a space in which the first block 21 is provided can be efficiently used, and the hydraulic control device for a loader can be prevented from increasing in size even if the first pilot check valve 18 and the flow dividing valve 14 are formed integrally with the arm direction changeover valve 11.

Additionally, according to the hydraulic control device for a loader 1, both the first pilot check valve 18 and the return oil passage open-close valve 15 are disposed in the first block 21. Therefore, a space in which the first block 21 is provided can be efficiently used, and the hydraulic control device for a loader can be prevented from increasing in size even if the first pilot check valve 18 and the return oil passage open-close valve 15 are formed integrally with the arm direction changeover valve 11.

Additionally, according to the hydraulic control device for a loader 1, both the second pilot check valve 19 and the variable throttle 16 are disposed in the second block 22. Therefore, a space in which the second block 22 is provided can be efficiently used, and the hydraulic control device for a loader can be prevented from increasing in size even if the second pilot check valve 19 and the variable throttle 16 are formed integrally with the arm direction changeover valve 11.

Additionally, according to the hydraulic control device for a loader 1, the first block 21 is disposed between the arm block 20 in which the arm direction changeover valve 11 is disposed and the bucket block 23 in which the bucket direction changeover valve 12 is disposed. The flow dividing valve 14 and the return oil passage open-close valve 15 both of which are disposed in the first block 21 lie in a plane perpendicular to a plane in which the arm direction changeover valve 11 and the bucket direction changeover valve 12 lie. Therefore, the hydraulic control device for a loader can be prevented from being elongated in one direction even if the flow dividing mechanism including the flow dividing valve 14 and the return oil passage open-close valve 15 is disposed between the arm direction changeover valve 11 and the bucket direction changeover valve 12, and is formed integrally with these valves. This makes it easy to secure the space to install the hydraulic control device for a loader in a material handling machine. Therefore, the hydraulic control device for a loader 1 can be prevented from increasing in size even if the arm direction changeover valve 11, the bucket direction changeover valve 12, and the flow dividing mechanism are formed integrally with each other.

Additionally, according to the hydraulic control device for a loader 1, the variable throttle 16 that adjusts the amount of oil to be selectively flowed is disposed in the second block 22 contiguous to the first block 21, in which the flow dividing valve 14 and the return oil passage open-close valve 15 are disposed, on the opposite side with respect to the arm block 20. Therefore, the variable throttle 16 is disposed in the second block 22 near the flow dividing valve 14, and hence the length of an oil passage through which the flow dividing valve 14 and the variable throttle 16 are connected together can be shortened, and the space in which the second block 22 is provided can be efficiently used. Therefore, the hydraulic control device for a loader can be prevented from increasing in size even if the flow dividing mechanism including the variable throttle 16 is formed integrally with the arm direction changeover valve 11 and the bucket direction changeover valve 12.

Additionally, according to the hydraulic control device for a loader 1, the flow dividing valve 14 and the return oil passage open-close valve 15 are disposed between the arm direction changeover valve 11 and the bucket direction changeover valve 12. The arm second port 34 and the variable throttle 16 are provided in the second block 22 disposed between the arm direction changeover valve 11 and the bucket direction changeover valve 12. Therefore, when an oil passage leading to the variable throttle 16 from the arm second port 34 is formed, the length of this oil passage can be minimized by providing the arm second port 34 and the variable throttle 16 in the second block 22, and the space in which the second block 22 is provided can be efficiently used. Therefore, the hydraulic control device for a loader can be prevented from increasing in size even if the flow dividing mechanism including the variable throttle 16 is formed integrally with the arm direction changeover valve 11 and the bucket direction changeover valve 12.

Additionally, according to the hydraulic control device for a loader 1, the first block 21 in which the flow dividing valve 14 and the return oil passage open-close valve 15 are provided is disposed between the arm direction changeover valve 11 and the second block 22. As a result, the flow dividing valve 14 and the return oil passage open-close valve 15 are disposed between the arm second port 34 and the arm direction changeover valve 11. Therefore, when an oil passage leading to the flow dividing valve 14 from the arm second port 34 and the variable throttle 16 is formed, the length of this oil passage can be minimized, and the space in which the first block 21 is provided can be efficiently used.

Additionally, according to the hydraulic control device for a loader 1, the overload relief valve 17, the arm second port 34, and the variable throttle 16 are provided in the second block 22. Therefore, the space in which the second block 22 is provided can be efficiently used, and the hydraulic control device for a loader can be prevented from increasing in size.

Additionally, according to the hydraulic control device for a loader 1, either the first pilot check valve 18 or the second pilot check valve 19, the arm second port 34, and the variable throttle 16 are provided in the second block 22. Therefore, the space in which the second block 22 is provided can be efficiently used, and the hydraulic control device for a loader can be prevented from increasing in size.

The first embodiment of the present invention has been described as above, and, as a matter of course, all modifications, applications, and equivalents falling within the scope of the appended claims, which will become apparent from reading and understanding this specification, are intended to be included in the scope of the present invention. For example, the second pilot check valve may be provided in the first block, and the first pilot check valve may be provided in the second block. The arm block, the first block, and the second block are not necessarily required to be arranged in the same order as in the above embodiment, and what is required is to arrange these three blocks side by side so that the first block and the second block are contiguous to each other.

Second Embodiment

Figure 5:
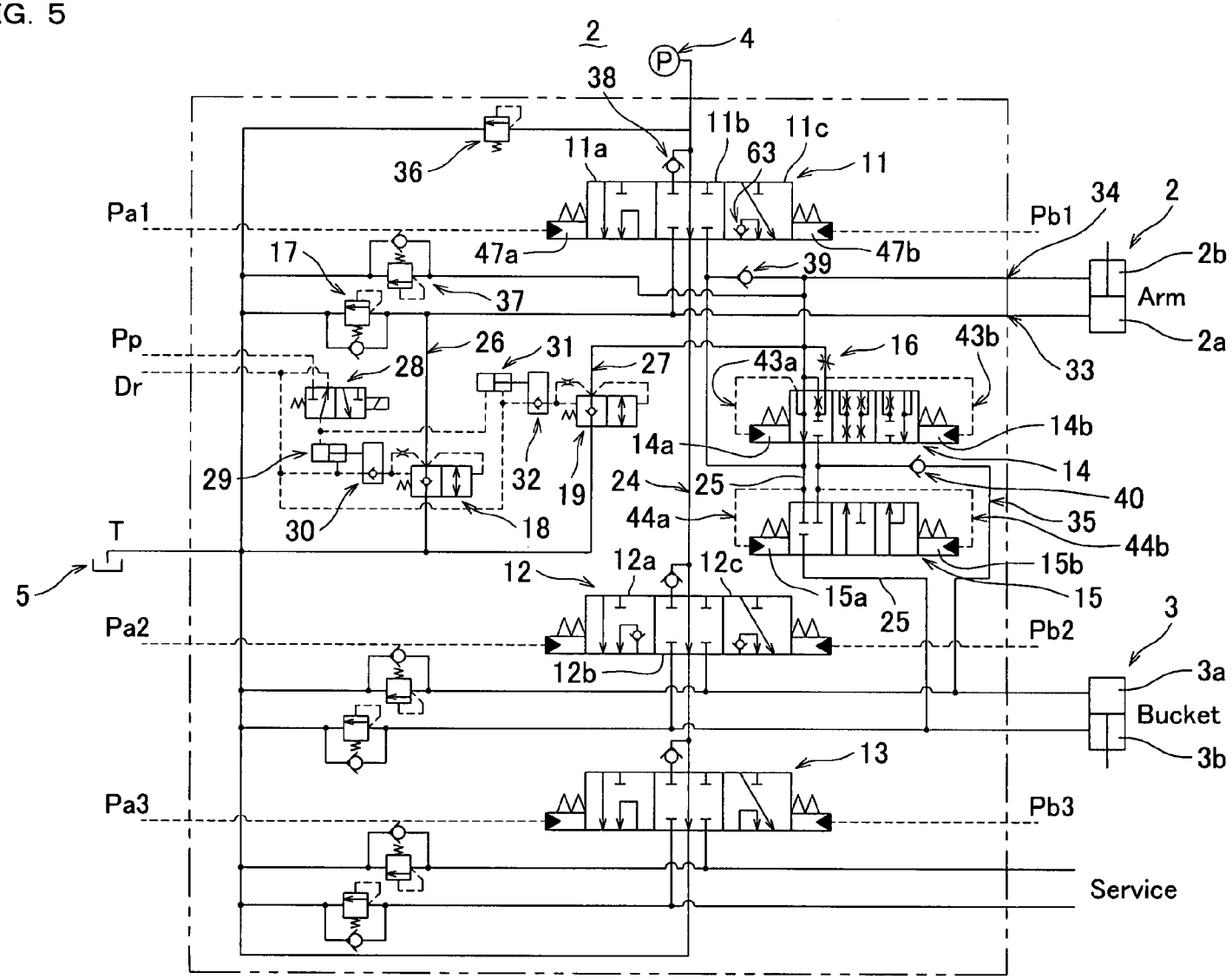
FIG. 5 is a hydraulic circuit diagram of a hydraulic control device for a loader according to a second embodiment of the present invention.

FIG. 5 is a hydraulic circuit diagram of a hydraulic control device for a loader 2 according to a second embodiment of the present invention. The hydraulic control device for a loader 2 shown in FIG. 5 is included in a construction machine (not shown) or a material handling machine (not shown), and is used as a hydraulic control device for controlling the operation of a front loader of the material handling machine provided with an arm and a bucket. In substantially the same way as the hydraulic control device for a loader 1 according to the first embodiment, the hydraulic control device for a loader 2 according to the second embodiment is made up of an arm direction changeover valve 11, a bucket direction changeover valve 12, a service direction changeover valve 13, a flow dividing valve 14, a return oil passage open-close valve 15, a variable throttle 16, overload relief valves 17 and 37, a first pilot check valve 18, a second pilot check valve 19, a main relief valve 36, etc.

As shown in FIG. 5, the hydraulic control device for a loader 2 has a center bypass passage 24 connected to an oil pressure pump 4 that is an oil pressure source in the same way as the hydraulic control device for a loader 1 according to the first embodiment. Pressure oil supplied from the oil pressure pump 4 is flowed to a tank 5 through the center bypass passage 24. As the hydraulic control device for a loader 1, the hydraulic control device for a loader 2 includes the arm direction changeover valve 11, the bucket direction changeover valve 12, and the service direction changeover valve 13 that are disposed along the center bypass passage 24. Pressure oil is supplied to the respective direction changeover valves 11, 12, and 13 through parallel passages. Thus, the hydraulic control device for a loader 2 is formed as a multi-direction changeover valve. In the attached drawings, the same reference character is given to the same constituent as in the first embodiment, and a repeated, detailed description of the same is appropriately omitted in the following specification.

The arm direction changeover valve 11 is formed as a direction changeover valve that controls a supply of pressure oil to an arm cylinder 2 from the center bypass passage 24. The arm is raised or lowered by switching the arm direction changeover valve 11. The bucket direction changeover valve 12 is formed as a direction changeover valve that controls a supply of pressure oil to a bucket cylinder 3 from the center bypass passage 24. The bucket is moved in a scooping direction (i.e., backward tilting direction) or in a dumping direction (i.e., forward tilting direction) by switching the bucket direction changeover valve 12.

When the arm direction changeover valve 11 is operated to perform switching to the changeover position 11*a*, the flow dividing valve 14 divides the flow of pressure oil returned from the second chamber 2*b* of the arm cylinder 2 and then supplies part of the pressure oil to the first chamber 3*a* of the bucket cylinder 3, and, as a result, the bucket is moved at a constant angle with the ground surface (in a parallel state, e.g., in a horizontal state with respect to the ground surface) while the arm is being raised. When the bucket is moved in a parallel state, the return oil passage open-close valve 15 opens or closes a return oil passage 25 through which pressure oil returned from the second chamber 3*b* of the bucket cylinder 3 flows. The flow dividing valve 14 and the return oil passage open-close valve 15 are disposed between the arm direction changeover valve 11 and the bucket direction changeover valve 12.

The variable throttle 16 adjusts the amount of oil which is pressure oil returned from the second chamber 2*b* of the arm cylinder 2 and which is part of the pressure oil to be flowed to the bucket cylinder 3 when the arm is raised. The overload relief valve 17 located on the side of the first chamber 2*a* communicates with the first chamber 2*a* of the arm cylinder 2, and can allow the first chamber 2*a* of the arm cylinder 2 to communicate with the tank 5 in accordance with the pressure of pressure oil. The overload relief valve 37 located on the side of the second chamber 2*b* communicates with the second chamber 2*b* of the arm cylinder 2, and can allow the second chamber 2*b* of the arm cylinder 2 to communicate with the tank 5 in accordance with the pressure of pressure oil. The main relief valve 36 is connected to the center bypass passage 24, and is formed so that the center bypass passage 24 and the tank 5 can be connected together in accordance with the pressure of pressure oil.

The first pilot check valve 18 is disposed in an oil passage 26 through which the first chamber 2*a* of the arm cylinder 2 is connected to the tank 5. The first pilot check valve 18 serves as a check valve that blocks the flow of pressure oil from the first chamber 2*a* to the tank 5, and is opened by the operation of an electromagnetic valve 28. The second pilot check valve 19 is disposed in an oil passage 27 through which the second chamber 2*b* of the arm cylinder 2 is connected to the tank 5. The second pilot check valve 19 serves as a check valve that blocks the flow of pressure oil from the second chamber 2*b* to the tank 5, and is opened by the operation of the electromagnetic valve 28.

Next, a description will be given of the operation of the hydraulic control device for a loader 2 having the circuit structure described above. The arm is raised by switching the arm direction changeover valve 11 to the changeover position 11*a*, and is lowered by switching the arm direction changeover valve 11 to the changeover position 11*c*. The bucket is moved in the scooping direction by switching the bucket direction changeover valve 12 to the changeover position 12*a*, and is moved in the dumping direction by switching the bucket direction changeover valve 12 to the changeover position 12*c*.

The hydraulic control device for a loader 2 has a parallel movement function to move the bucket while the bucket is kept at a constant angle with the ground surface when the arm is raised. When the arm direction changeover valve 11 is switched to the changeover position 11*a*, pressure oil flowed from the oil pressure pump 4 is supplied to the first chamber 2*a* of the arm cylinder 2, and the arm begins rising. At this time, pressure oil returned from the second chamber 2*b* of the arm cylinder 2 flows to the flow dividing valve 14. The pressure oil that has flowed to the flow dividing valve 14 acts on two oil pressure chambers provided on both sides of the flow dividing valve 14 through pilot oil passages 43*a* and 43*b*, thereby the position of the flow dividing valve 14 is changed. As a result, the flow of the pressure oil returned from the second chamber 2*b* of the arm cylinder 2 is divided, and part of the pressure oil returned therefrom is supplied to the first chamber 3*a* of the bucket cylinder 3 through an oil passage 35. The remaining pressure oil is flowed from the center bypass passage 24 to the tank 5 through the arm direction changeover valve 11. The amount of oil that is pressure oil returned from the arm cylinder 2 and that is part of the pressure oil to be supplied to the bucket cylinder 3 is appropriately adjusted by the variable throttle 16.

The pressure oil the flow of which is divided by the flow dividing valve 14 and is then flowed to the arm direction changeover valve 11 and the pressure oil that is supplied to the bucket cylinder 3 act on the oil pressure chambers 15*a* and 15*b* provided on both sides of the return oil passage open-close valve 15 through pilot oil passages 44*a* and 44*b* respectively as pilot pressure oil. Accordingly, the return oil passage open-close valve 15 is changed from a state of closing the return oil passage 25 to a state of opening the return oil passage 25, so that the pressure oil returned from the second chamber 3*b* of the bucket cylinder 3 is flowed through the return oil passage 25, is then passed through the arm direction changeover valve 11, and is flowed into the tank 5. Therefore, the bucket parallel movement function can be fulfilled by allowing the bucket to move in the dumping direction when the arm is raised.

As in the hydraulic control device for a loader 1 according to the first embodiment, a floating function to bring the arm into a floating state is fulfilled in the hydraulic control device for a loader 2.

Figure 6:
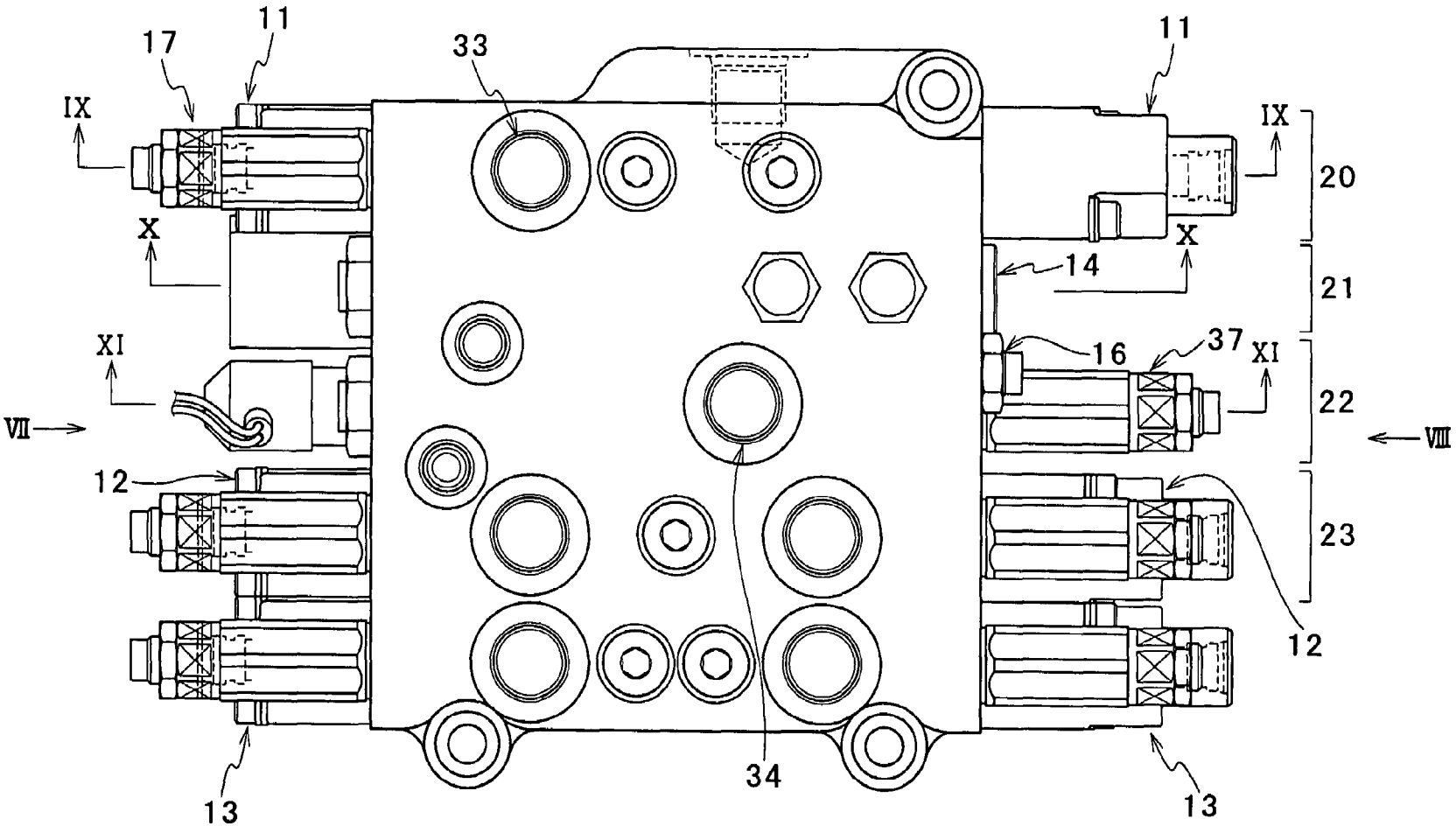
FIG. 6 is a plan view showing the externals of the hydraulic control device for a loader of FIG. 5.

Next, a description will be given of an arrangement of the constituents of the hydraulic control device for a loader 2 with reference to FIG. 6 to FIG. 11. First, based on the views of the externals of the hydraulic control device 2 shown in FIG. 6 to FIG. 8, an arrangement of the constituents of the hydraulic control device for a loader 2 will be described. FIG. 6 is a plan view showing the externals of the hydraulic control device for a loader 2, FIG. 7 is a side view from arrow VII of FIG. 6, and FIG. 8 is a side view from arrow VIII of FIG. 6.

Figure 7:
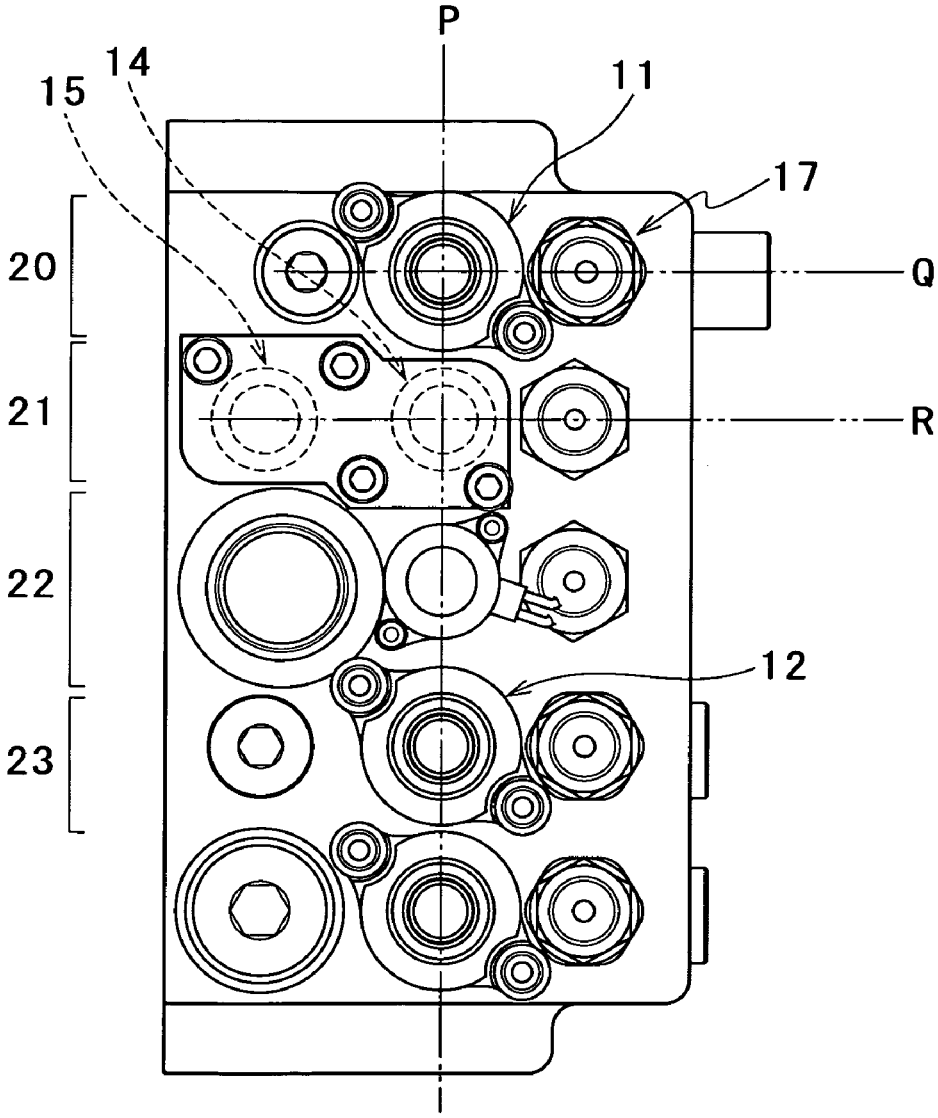
FIG. 7 is a side view from arrow VII of FIG. 6.
Figure 8:
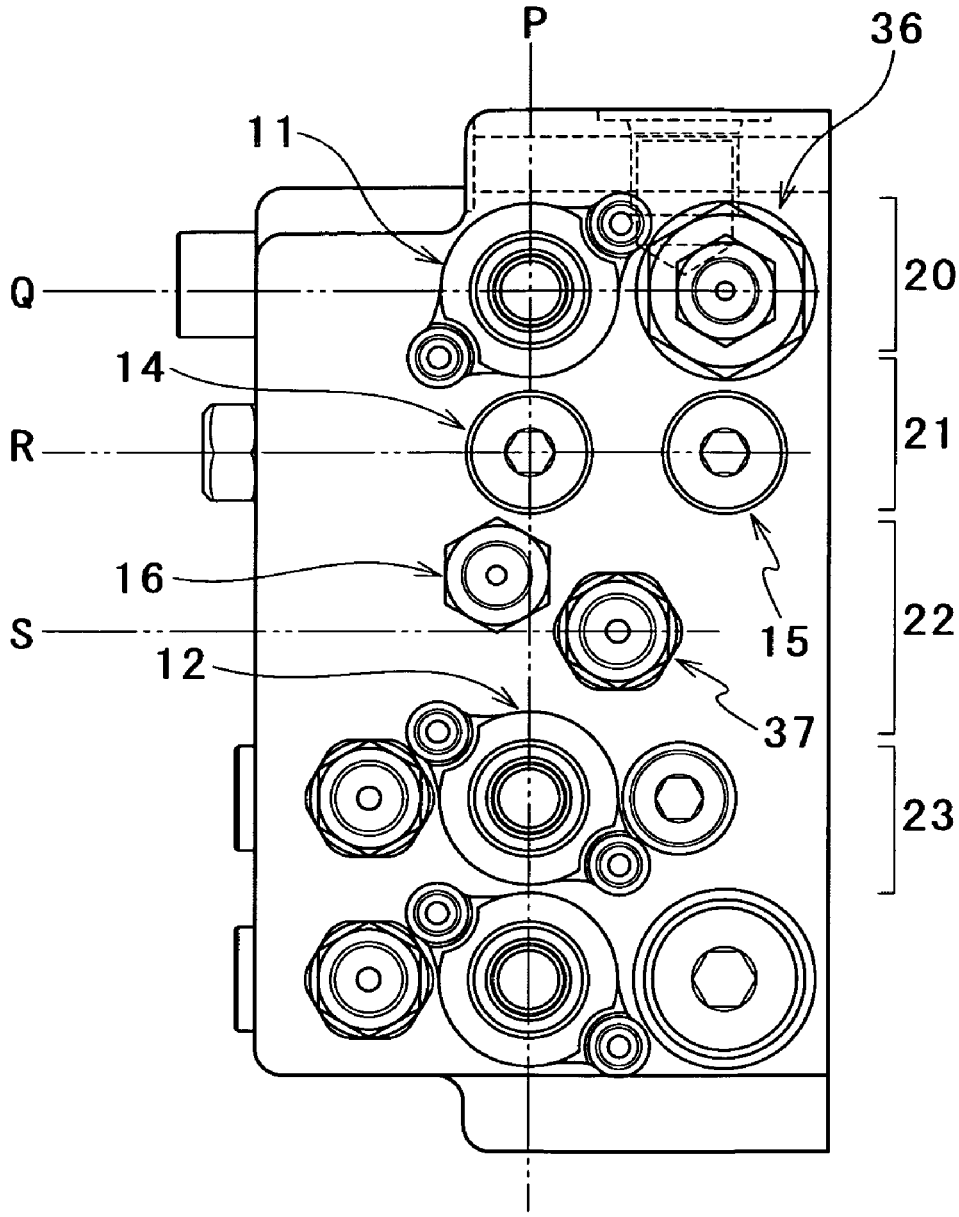
FIG. 8 is a side view from arrow VIII of FIG. 6.

As shown in FIG. 6 to FIG. 8, the hydraulic control device for a loader 2 is made up of an arm block 20, a first block 21, a second block 22, a bucket block 23, etc. These blocks 20, 21, 22, and 23 are formed integrally with each other. The arm direction changeover valve 11 is provided in the arm block 20, and the bucket direction changeover valve 12 is provided in the bucket block 23. The first block 21 is disposed between the arm block 20 and the bucket block 23, whereas the second block 22 is disposed between the first block 21 and the bucket block 23. That is, the hydraulic control device for a loader 2 has the arm block 20, the first block 21, the second block 22, and the bucket block 23 formed integrally with each other in this order.

The flow dividing valve 14 and the return oil passage open-close valve 15 are provided in the first block 21. As is clearly shown in FIG. 8, the flow dividing valve 14 and the return oil passage open-close valve 15 lie in an orthogonal plane R (i.e., a plane that is shown by the alternate long and two short dashes line R and that is perpendicular to the sheet of paper of FIG. 7 or 8) perpendicular to a block crossing plane P (i.e., a plane that is shown by the alternate long and two short dashes line P and that is perpendicular to the sheet of paper of FIG. 7 or 8) in which the arm direction changeover valve 11 and the bucket direction changeover valve 12 lie.

The overload relief valve 17 located on the first-chamber side and the main relief valve 36, in addition to the arm direction changeover valve 11, are provided in the arm block 20. As is clearly shown in FIG. 7 and FIG. 8, the arm direction changeover valve 11, the first-chamber-side overload relief valve 17, and the main relief valve 36 are arranged in a three-stacked manner in a first plane Q of the arm block 20 that is parallel to the orthogonal plane R (i.e., a plane that is shown by the alternate long and two short dashes line Q and that is perpendicular to the sheet of paper of FIG. 7 or 8).

The variable throttle 16 and the overload relief valve 37 located on the second-chamber side are provided in the second block 22. As is clearly shown in FIG. 8, the variable throttle 16 is disposed between the orthogonal plane R and a second plane S of the second block 22 (i.e., a plane that is shown by the alternate long and two short dashes line S and that is perpendicular to the sheet of paper of FIG. 8) in which the second-chamber-side overload relief valve 37 lie and that is parallel to the orthogonal plane R. The variable throttle 16 is disposed so as to be parallel to the second-chamber-side overload relief valve 37 between the second plane S and the orthogonal plane R and so as to be overlapped with the second-chamber-side overload relief valve 37 in the direction perpendicular to the block crossing plane P.

Figure 9:
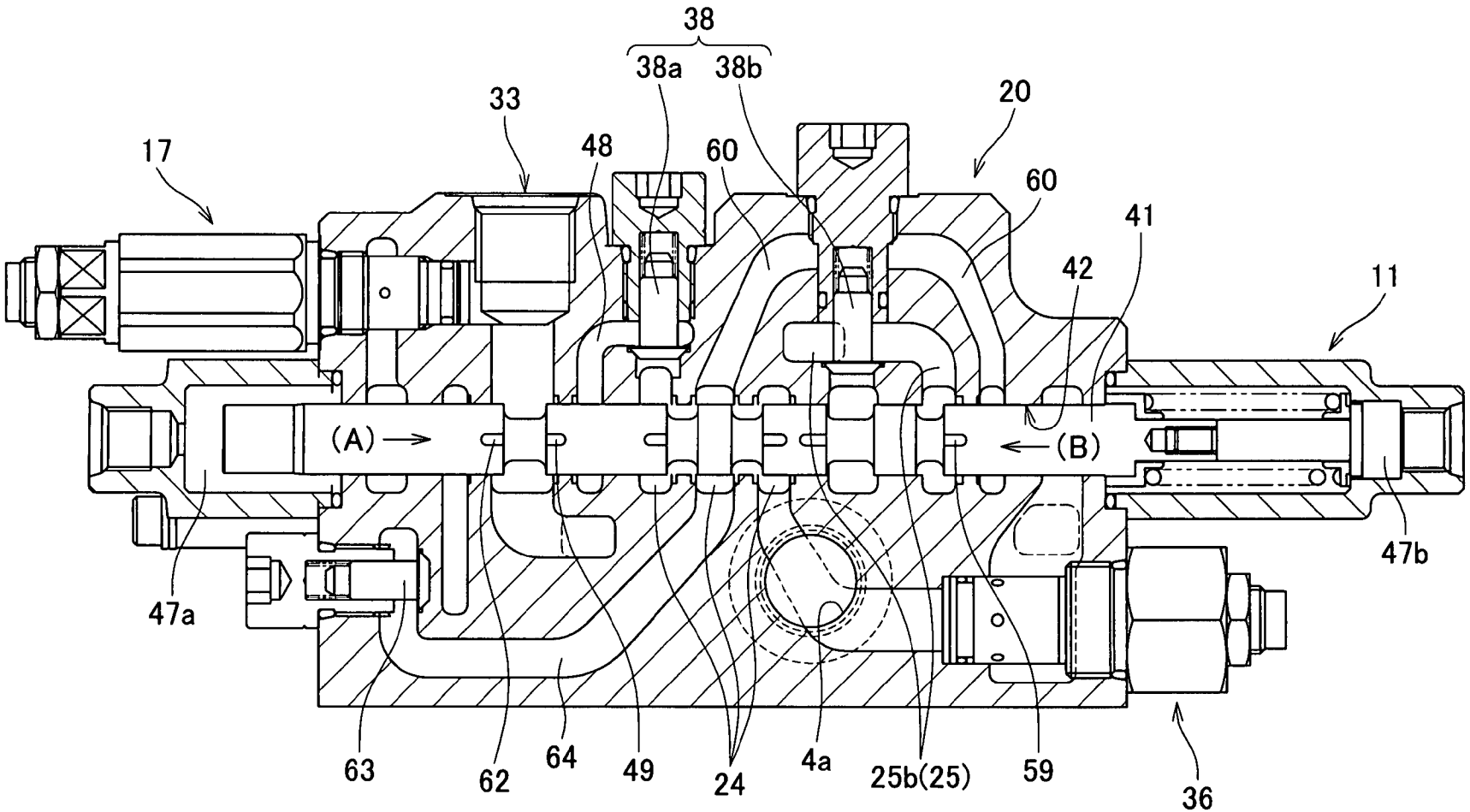
FIG. 9 is a cross-sectional view along line IX-IX of FIG. 6.
Figure 10:
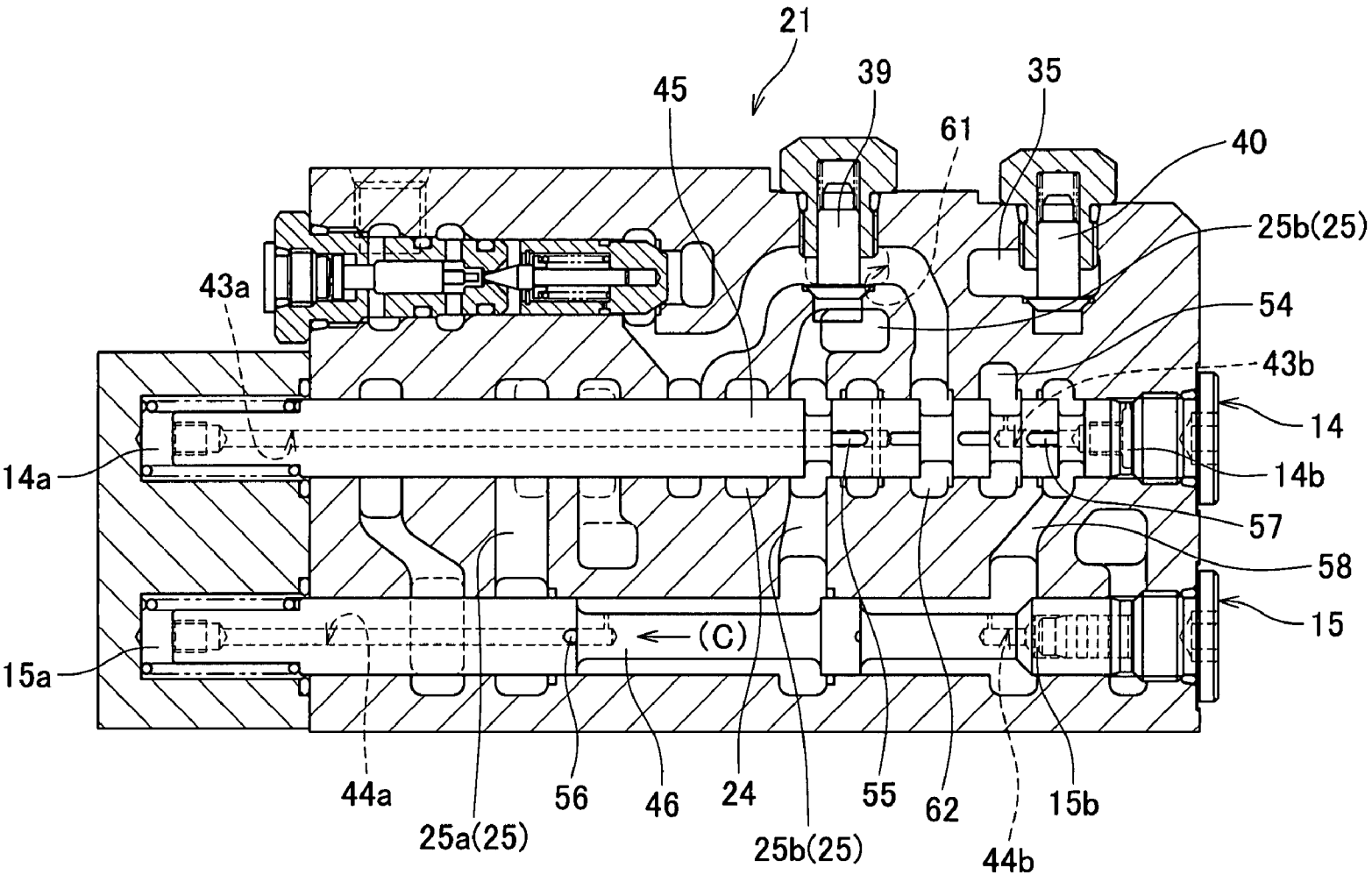
FIG. 10 is a cross-sectional view along line X-X of FIG. 6.
Figure 11:
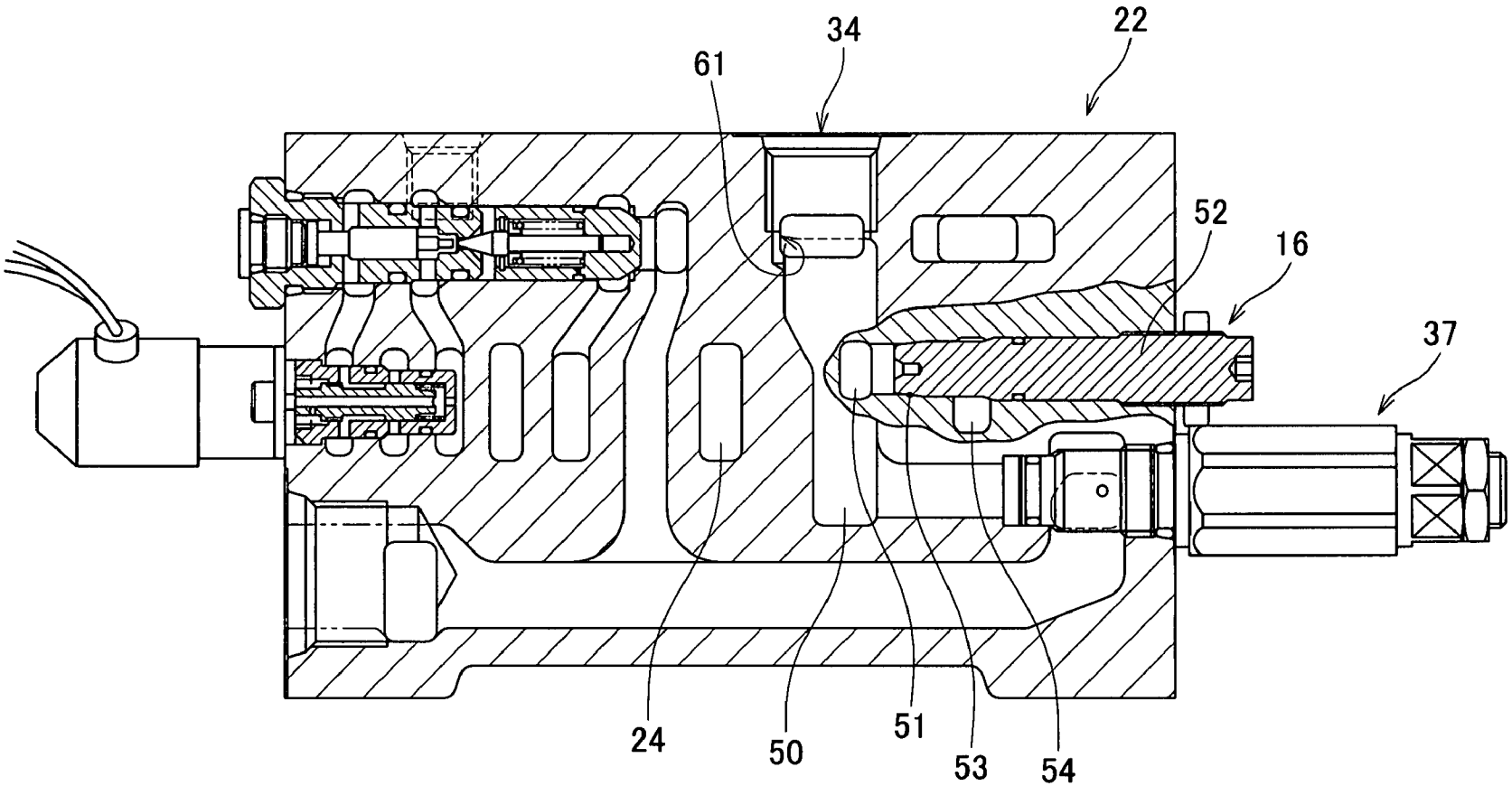
FIG. 11 is a cross-sectional view along line XI-XI of FIG. 6.

Next, a detailed description will be given of a cross-sectional structure of each of the arm block 20, the first block 21, and the second block 22 with reference to cross-sectional views shown in FIG. 9 to FIG. 11. FIG. 9 is a cross-sectional view along line IX-IX of FIG. 6, showing a cross section in the first plane Q of the arm block 20. FIG. 10 is a cross-sectional view along line X-X of FIG. 6, showing a cross section in the orthogonal plane R of the first block 21. FIG. 11 is a cross-sectional view along line XI-XI of FIG. 6, showing a cross section in the second plane S of the second block 22.

As shown by the cross-sectional view in the first plane Q of FIG. 9, in the arm block 20, the arm direction changeover valve 11 including a spool 41 and a spool hole 42, the first-chamber-side overload relief valve 17, and the main relief valve 36 are arranged in a three-stacked manner in the first plane Q. The arm block 20 has an arm first port 33 that is one port leading to the arm direction changeover valve 11 (see FIG. 6 and FIG. 9). The arm first port 33 is connected to the first chamber 2*a* of the arm cylinder 2 (see FIG. 5). The arm block 20 additionally has a check valve 38*a* disposed in the pressure oil passage between the center bypass passage 24 and the arm first port 33 and a check valve 38*b* disposed in the pressure oil passage between the center bypass passage 24 and the arm second port 34 (see FIG. 5, FIG. 6, and FIG. 11), which are constituents making up the check valve 38 of FIG. 5. The port 4*a* leads to the pump 4 and to ports on both sides of the center bypass passage 24. The arm second port 34 is the other port leading to the arm direction changeover valve 11, and is connected to the second chamber 2*b* of the arm cylinder 2.

As shown by the cross-sectional view in the orthogonal plane R of FIG. 10, in the first block 21, the flow dividing valve 14 and the return oil passage open-close valve 15 are arranged side by side in parallel in the orthogonal plane R. The pilot oil passage 43*a* leading to the oil pressure chamber 14*a* and the pilot oil passage 43*b* leading to the oil pressure chamber 14*b* are formed inside a spool 45 of the flow dividing valve 14. The pilot oil passage 44*a* leading to the oil pressure chamber 15*a* and the pilot oil passage 44*b* leading to the oil pressure chamber 15*b* are formed inside a spool 46 of the return oil passage open-close valve 15. The first block 21 includes a check valve 39 disposed in the pressure oil passage between the arm direction changeover valve 11 and the arm second port 34 and a check valve 40 disposed in the pressure oil passage between the flow dividing valve 14 and the first chamber 3*a* of the bucket cylinder 3 (see FIG. 5 and FIG. 10).

As shown by the cross-sectional view in the second plane S of FIG. 11, the second-chamber-side overload relief valve 36 lies in the second plane S of the second block 22. As shown by the partially cutaway cross-sectional view of FIG. 11, in the second block 22, the variable throttle 16 is disposed to be overlapped with the second-chamber-side overload relief valve 37 in parallel with this overload relief valve 37 and in the direction perpendicular to the block crossing plane P. The second block 22 additionally has the arm second port 34.

Lastly, a description will be given of the operation performed when the arm direction changeover valve 11 is switched to the changeover position 11*a* and to the changeover position 11*c* in the hydraulic control device for a loader 2 in which each of the blocks 20, 21, and 22 has the cross-sectional structure of each of the FIGS. 9 to 11.

As shown in FIG. 9, in the arm direction changeover valve 11 being in the state of the neutral position 11*b*, when pilot pressure oil is introduced into the oil pressure chamber 47*a*, the spool 41 is moved in the direction indicated by arrow (A) of FIG. 9, so that switching is performed to the changeover position 11*a*. Accordingly, pressure oil flowed from the center bypass passage 24 is supplied to the first chamber 2*a* of the arm cylinder 2 through the check valve 38*a*, an oil passage 48, a notch 49, and the arm first port 33. At this time, part of the pressure oil returned from the second chamber 2*b* of the arm cylinder 2 is introduced into the pilot passage 43*a* through the arm second port 34, the oil passage 50, the oil passage 61, and the oil passage 62, and then acts on the oil pressure chamber 14*a* as shown in FIG. 7 and FIG. 6. On the other hand, part of the pressure oil returned therefrom and guided to the oil passage 51 is introduced into the pilot oil passage 43*b* through a throttle 53 formed as a gap between a throttle-adjusting member 52 and the main part of the second block 22 in the variable throttle 16 and through an oil passage 54, and then acts on the oil pressure chamber 14*b*. As a result, the spool 45 is moved so as to change the position of the flow dividing valve 14, and the flow of the pressure oil is divided as described with reference to FIG. 5. As shown in FIG. 10, in the first block 21, a cut part that forms the oil passage 54 leading to the pilot oil passage 43*b* is formed to become greater in the radial direction of the spool 45 than the other cut parts opened to the spool hole of the flow dividing valve 14, in order to make a connection to the variable throttle 16.

As shown in FIG. 10, the pressure oil returned therefrom and guided to the oil passage 62 is introduced into the pilot oil passage 44*a* through a notch 55 and an oil passage 25*b* (i.e., part of the return oil passage 25), and then acts on the oil pressure chamber 15*a*. The pressure oil returned therefrom and guided to the oil passage 54 is introduced into the pilot oil passage 44*b* through a notch 57 and an oil passage 58, and then acts on the oil pressure chamber 15*b*. As a result, the spool 46 is moved in the direction of arrow (C) of FIG. 10, and the return oil passage open-close valve 15 is switched to the state of opening the return oil passage 25 as described with reference to FIG. 5. In other words, the pressure oil from the second chamber 3*b* of the bucket cylinder 3 is returned to the center bypass passage 24 through an oil passage 25*a* (part of the return oil passage 25), a notch 56, and the oil passage 25*b* and through a notch 59 and an oil passage 60 shown in FIG. 5.

On the other hand, in the arm direction changeover valve 11 being in the state of the neutral position 11*b* shown in FIG. 9, when pilot pressure oil is introduced into the oil pressure chamber 47*b*, the spool 41 is moved in the direction indicated by arrow (B) of FIG. 9, and switching is performed to the changeover position 11*c*. Accordingly, the pressure oil from the center bypass passage 24 is supplied to the second chamber 2*b* of the arm cylinder 2 through the check valve 38*b*, the oil passage 25*b*, the check valve 39 shown in FIG. 10, the oil passage 61 shown in FIG. 11 (whose correlation is likewise shown by the dotted line in FIG. 10), and the arm second port 34. The pressure oil from the first chamber 2*a* of the arm cylinder 2 is returned to the center bypass passage 24 through the arm first port 33, the check valve 63, and the oil passage 64 as shown in FIG. 9.

As described above, according to the hydraulic control device 2 for a loader in this embodiment, the first block 21 is disposed between the arm block 20 including the arm direction changeover valve 11 and the bucket block 23 including the bucket direction changeover valve 12. The flow dividing valve 14 and the return oil passage open-close valve 15 provided in the first block 21 lie in the orthogonal plane R perpendicular to the block crossing plane P in which the arm direction changeover valve 11 and the bucket direction changeover valve 12 lie. Further, in the first plane Q of the arm block 20 parallel to the orthogonal plane R, the arm direction changeover valve 11, the first-chamber-side overload relief valve 17, and the main relief valve 36 are arranged in a three-stacked manner. Therefore, the hydraulic control device for a loader 2 can be prevented from being elongated in one direction even if the flow dividing mechanism including the flow dividing valve 14 and the return oil passage open-close valve 15 is disposed between the arm direction changeover valve 11 and the bucket direction changeover valve 12, and is formed integrally therewith. Additionally, since the arm direction changeover valve 11, the first-chamber-side overload relief valve 17, and the main relief valve 36 are arranged in a three-stacked manner in the first plane Q parallel to the orthogonal plane R, the relief valves 17 and 36 can also be densely arranged in a narrow space in a compact manner, and the hydraulic control device for a loader 2 can be prevented from being elongated in one direction. This makes it easy to secure the installation space for the hydraulic control device for a loader 2 in the material handling machine. Therefore, according to this embodiment, the hydraulic control device for a loader 2 capable of preventing an increase in size can be provided even if the arm direction changeover valve 11, the bucket direction changeover valve 12, the flow dividing mechanism, and the relief valve (17, 36) are formed integrally with each other.

Additionally, according to the hydraulic control device for a loader 2, the variable throttle 16 and the second-chamber-side overload relief valve 37 are provided in the second block 22 located between the first block 21 and the bucket block 23. The variable throttle 16 is disposed to be overlapped with the second-chamber-side overload relief valve 37 in parallel with this overload relief valve 37 and in the direction perpendicular to the block crossing plane P between the orthogonal plane R and the second plane S in which the second-chamber-side overload relief valve 37 lies and that is parallel to the orthogonal plane R. Therefore, even if the variable throttle 16 that adjusts the amount of oil to be selectively flowed is attached to the flow dividing valve 14, the flow dividing valve 14 and the second-chamber-side overload relief valve 37 can be arranged close to the position where no interference occurs therebetween, and can be densely arranged in the narrow space in a compact manner. Therefore, even if the variable throttle 16 is attached to the flow dividing valve 14, the hydraulic control device for a loader 2 can be prevented from increasing in size.

The second embodiment of the present invention has been described as above, and, as a matter of course, all modifications, applications, and equivalents falling within the scope of the appended claims, which will become apparent from reading and understanding this specification, are intended to be included in the scope of the present invention.

INDUSTRIAL APPLICABILITY

In a front loader of a construction machine or a material handling machine provided with an arm and a bucket, the hydraulic control device for a loader of the present invention can be widely used as a hydraulic control device for a loader including a float mechanism by which the arm is brought into a floating state.

What is claimed is:

1. A hydraulic control device for a loader, comprising:

an arm direction changeover valve that controls a supply of pressure oil to an arm cylinder;

a bucket direction changeover valve that controls a supply of pressure oil to a bucket cylinder;

a first pilot check valve provided between a first chamber of the arm cylinder and a tank; and a second pilot check valve provided between a second chamber of the arm cylinder and the tank;

the hydraulic control device for a loader bringing an arm into a floating state by opening the first pilot check valve and the second pilot check valve; wherein the improvement comprises:

an arm block in which the arm direction changeover valve is provided;

a first block in which one of the first pilot check valve and the second pilot check valve is provided; and a second block in which the other one of the first pilot check valve and the second pilot check valve is provided; wherein the three blocks, namely, the arm block, the first block, and the second block are arranged side by side; and wherein the first block and the second block are arranged to be contiguous to each other.

2. The hydraulic control device for a loader according to claim 1, further comprising:

a flow dividing valve that, when the arm is operated, moves the bucket in a parallel state by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows; wherein the flow dividing valve is provided in the first block.

3. The hydraulic control device for a loader according to claim 1, further comprising:

a flow dividing valve that, when the arm is operated, moves the bucket in a parallel state by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows; wherein the return oil passage open-close valve is provided in the first block.

4. The hydraulic control device for a loader according to claim 1, further comprising:

a flow dividing valve that, when the arm is operated, moves the bucket in a parallel state by dividing a flow of pressure oil returned from the arm cylinder and then supplying part of the pressure oil to the bucket cylinder when the arm direction changeover valve is operated;

a return oil passage open-close valve that, when the bucket is moved in parallel, opens or closes a return oil passage through which pressure oil returned from the bucket cylinder flows; and a variable throttle that adjusts an amount of oil, the oil being part of the pressure oil returned from the arm cylinder and being selectively flowed to the bucket cylinder; wherein the variable throttle is provided in the second block.

5. A hydraulic control device for a loader, comprising:

an arm direction changeover valve that controls a supply of pressure oil to an arm cylinder;

a bucket direction changeover valve that controls a supply of pressure oil to a bucket cylinder;

a flow dividing valve that, when an arm is operated, moves a bucket in a parallel state by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows;

the flow dividing valve and the return oil passage open-close valve being disposed between the arm direction changeover valve and the bucket direction changeover valve; wherein the improvement comprises:

an arm block in which the arm direction changeover valve is provided;

a bucket block in which the bucket direction changeover valve is provided; and a first block disposed between the arm block and the bucket block; wherein the flow dividing valve and the return oil passage open-close valve are provided in the first block, and lie in a plane perpendicular to a plane in which the arm direction changeover valve and the bucket direction changeover valve lie.

6. The hydraulic control device for a loader according to claim 5, further comprising:

a variable throttle that adjusts an amount of oil, the oil being part of the pressure oil returned from the arm cylinder and being selectively flowed to the bucket cylinder;

the variable throttle being provided in a second block contiguous to the first block, in which the flow dividing valve and the return oil passage open-close valve are provided, on an opposite side of the arm block.

7. A hydraulic control device for a loader, comprising:

an arm direction changeover valve that controls a supply of pressure oil to an arm cylinder;

a bucket direction changeover valve that controls a supply of pressure oil to a bucket cylinder;

a flow dividing valve that, when an arm is operated, moves a bucket in a parallel state by dividing a flow of pressure oil returned from the arm cylinder and then supplying part of the pressure oil to the bucket cylinder when the arm direction changeover valve is operated;

a return oil passage open-close valve that, when the bucket is moved in parallel, opens or closes a return oil passage through which pressure oil returned from the bucket cylinder flows; and a variable throttle that adjusts an amount of oil, the oil being part of the pressure oil returned from the arm cylinder and being selectively flowed to the bucket cylinder;

the flow dividing valve and the return oil passage open-close valve being disposed between the arm direction changeover valve and the bucket direction changeover valve; wherein the improvement comprises:

an arm first port connected to a first chamber of the arm cylinder;

an arm second port connected to a second chamber of the arm cylinder; and a second block disposed between the arm direction changeover valve and the bucket direction changeover valve;

the arm second port and the variable throttle being provided in the second block.

8. The hydraulic control device for a loader according to claim 7, further comprising:

a first block disposed between the arm direction changeover valve and the second block; wherein the flow dividing valve and the return oil passage open-close valve are provided in the first block.

9. The hydraulic control device for a loader according to claim 7, wherein an overload relief valve communicating with the first chamber of the arm cylinder is provided in the second block in which the variable throttle is provided.

10. The hydraulic control device for a loader according to claim 7, further comprising:

a first pilot check valve provided between the first chamber of the arm cylinder and a tank; and a second pilot check valve provided between the second chamber of the arm cylinder and the tank; wherein either the first pilot check valve or the second pilot check valve is provided in the second block.

11. A hydraulic control device for a loader, comprising:

a center bypass passage connected to an oil pressure source;

an arm direction changeover valve that controls a supply of pressure oil from the center bypass passage to an arm cylinder;

a bucket direction changeover valve that controls a supply of pressure oil from the center bypass passage to a bucket cylinder;

a flow dividing valve that, when an arm is operated, moves a bucket while the bucket is kept at a constant angle with a ground surface by dividing a flow of pressure oil returned from the arm cylinder and then supplying part of the pressure oil to the bucket cylinder when the arm direction changeover valve is operated; and a return oil passage open-close valve that, when the bucket is moved in parallel, opens or closes a return oil passage through which pressure oil returned from the bucket cylinder flows;

the flow dividing valve and the return oil passage open-close valve being disposed between the arm direction changeover valve and the bucket direction changeover valve; wherein the improvement comprises:

an arm block in which the arm direction changeover valve is provided;

a bucket block in which the bucket direction changeover valve is provided; and a first block disposed between the arm block and the bucket block; wherein the flow dividing valve and the return oil passage open-close valve are provided in the first block, and lie in an orthogonal plane perpendicular to a block crossing plane in which the arm direction changeover valve and the bucket direction changeover valve lie; and wherein the arm direction changeover valve, a first-chamber-side overload relief valve that leads to a first chamber of the arm cylinder, and a main relief valve connected to the center bypass passage are arranged in a three-stacked manner in a first plane of the arm block that is parallel to the orthogonal plane.

12. The hydraulic control device for a loader according to claim 11, further comprising:

a second block disposed between the first block and the bucket block, the second block including:

a variable throttle that adjusts an amount of oil, the oil being part of the pressure oil returned from the arm cylinder and being selectively flowed to the bucket cylinder; and a second-chamber-side overload relief valve that leads to a second chamber of the arm cylinder; wherein the variable throttle is disposed to be overlapped with the second-chamber-side overload relief valve in parallel with the second-chamber-side overload relief valve and in a direction perpendicular to the block crossing plane between the orthogonal plane and a second plane of the second block in which the second-chamber-side overload relief valve lies and which is parallel to the orthogonal plane.

* * * * *